US005133613A

United States Patent [19]

Ikehata et al.

[11] Patent Number: 5,133,613

[45] Date of Patent: Jul. 28, 1992

[54] PRINTING HEAD USING STAGGERED ARRANGEMENT NEEDLES

[75] Inventors: Tsutomu Ikehata, Sakado; Hirofumi Suzuki, Tokorozawa; Katsuya Masuda, Tokyo; Makoto Yasunaga, Kawagoe; Yoshimasa Tai, Kawasaki, all of Japan

[73] Assignee: Citizen Watch Co., Ltd., Tokyo, Japan

[21] Appl. No.: 570,467

[22] Filed: Aug. 21, 1990

[30] Foreign Application Priority Data

Aug. 25, 1989 [JP] Japan ..... 1-217518

[51] Int. Cl.[5] ..... B41J 2/27

[52] U.S. Cl. ..... 400/124; 400/17; 400/157.2

[58] Field of Search ..... 400/124, 157.2, 17; 101/93.05, 93.29

[56] References Cited

FOREIGN PATENT DOCUMENTS 83464 5/1982 Japan ..... 400/124
168581 10/1983 Japan ..... 400/124
179759 8/1986 Japan ..... 400/124

*Primary Examiner*—Edgar S. Burr

*Assistant Examiner*—Stephen R. Funk

*Attorney, Agent, or Firm*—Lowe, Price, Leblanc & Becker

[57] ABSTRACT

A printing head includes solenoids arranged in an annular array for driving needles which are arranged in a zigzag array of two vertical columns. Solenoids corresponding to needles forming one of the columns are arranged on a semicircle of the annular array in the same order as that of the needles on the needle column. Two solenoids respectively corresponding to needles disposed at lower ends of the two needle columns are designed to generate magnetic fluxes whose directions are the same. During underline printing where these two solenoids are alternately energized, the magnetic flux generated by one of the solenoids never acts to increase an effective magnetic flux of the other solenoid at an initial stage of the excitation period thereof, so that the needle of the first solenoid reaches its forwardmost position at an appropriate time. The needle is rapidly restored and its tip prevented from being caught by the ink ribbon. After the forwardmost position is reached by the needle associated with the first solenoid, the magnetic flux generated by the second solenoid never acts to increase the magnetic flux of the first, permitting rapid restoration of the needle.

1 Claim, 6 Drawing Sheets

PRINTING HEAD USING STAGGERED ARRANGEMENT NEEDLES

BACKGROUND OF THE INVENTION

The present invention relates to a printing head of an impact dot printer, and more particularly, to a printing head capable of smoothly moving reciprocating needles whose tips are arranged in two vertical columns, thereby preventing damage from the needles and ribbon jamming.

In an impact dot printer the needles having tips are arranged in a zigzag array of two vertical columns, along with solenoids for driving the needles are disposed in an annular array. It is known to arrange the solenoids, associated with needles of one needle column, on a corresponding semicircle of the annular array in the same order as that of the needles in that needle column. In this case, two solenoids, associated with two laterally adjacent needles at the upper ends of the two vertical columns forming the zigzag array, are disposed to be adjacent to each other on the annular array. Also, two solenoids associated with two laterally adjacent needles at the lower end of the zigzag array are adjacent to each other on the annular array.

During the printing process, one or more solenoids are energized to generate magnetic flux thereby forwardly moving one or more needles, each coupled to an associated armature arranged to be pivoted upon generation of the magnetic flux. Further, the printer operates to cause each solenoid to be deenergized at a desired timing so that the magnetic flux is extinguished when the needle reaches its forwardmost position, thereby permitting the needle to be restored by the spring force of an associated spring. Moreover, in the conventional printer, the solenoids are so designed that the direction of the magnetic flux generated by one of adjacent solenoids is opposite to that of magnetic flux generated by the other solenoid, for reduction of magnetic interference between the adjacent solenoids.

The conventional printer, which is arranged to generate, by each adjacent solenoid pair, magnetic fluxes whose directions are opposite to each other. When two solenoids corresponding to laterally adjacent needles at the lower end of the zigzag array of two vertical columns are alternately energized for printing an underline, for instance, the timing of the solenoid operation is altered due to the effect of the magnetic flux generated by another solenoid. Consequently, reciprocal movement of the needle concerned is adversely affected. For example, if part of the magnetic flux generated by one of the solenoids acts on another solenoid when the magnetic flux of the latter solenoid is extinguished, the backward movement of the needle associated with the latter solenoid is prolonged. In this case, the tip of the needle can be caught by the ribbon tape to cause damage to the needle or ribbon from jamming.

A dot printer, which is so designed that the direction of magnetic fluxes generated by some of a plurality of electromagnets which cooperate to form a common magnetic flux path is opposite to that of magnetic fluxes generated by remaining electromagnets, is described in Japanese Patent Publication No. 58-35475. However, this publication merely contemplates reducing a magnetic flux amount in the common magnetic flux path. The cross section area of the magnetic flux path is reduced, thereby providing a compact printing head. This printer still entails the aforesaid drawback.

SUMMARY OF THE INVENTION

The object of the present invention is to provide a printing head capable of smoothly moving reciprocating needles whose tips are arranged in two vertical columns, thereby preventing damage to the needles and ribbon by jamming.

According to the present invention, there is provided a printing head which has needles whose tips are arranged in two vertical columns consisting of first and second needle columns, and solenoids for driving the needles, which respectively correspond to the needles and are arranged in an annular array. The needles consist of first and second needle groups respectively forming the first and second needle columns, and the solenoids consist of first and second solenoid groups respectively corresponding to the first and second needle groups. The solenoids forming each solenoid group are arranged on a corresponding one semicircle of the annular array in the same order as that of the needles forming a corresponding one needle column. Adjacent ones of the solenoids forming each solenoid group are so designed as to generate, when energized, magnetic fluxes whose directions are opposite to each other. At least one of two solenoids of the first solenoid group, which are disposed at opposite ends of the corresponding semicircle of the annular array, and at least one solenoid of the second solenoid group, which is adjacent to the one solenoid of the first solenoid group, are so designed as to generate, when energized, magnetic fluxes whose directions are the same with each other.

The present invention is advantageous in that an effective generation or effective extinction timing of a magnetic flux can be effected. The magnetic flux is generated by one of two solenoids, that are alternately energized for printing an upperline or underline. Operation can be prevented from being dislocated from a desired timing. This dislocation would be otherwise attributable to a magnetic flux generated by another solenoid. The associated needle can be smoothly reciprocated, because of the aforesaid particular arrangement wherein solenoids which are associated with needles cooperating to form one of two vertical columns are arranged on one semicircle of the annular solenoid array in the same order as that of these needles in the one needle column. One solenoid, associated with the needle disposed at the upper or lower end of the one needle column, and another solenoid, adjacent to the former solenoid and associated with the needle which is disposed at the upper or lower end of the other needle column, are designed to generate magnetic fluxes whose directions are the same. As a consequence, prevention of each needle from being caught by the ribbon tape can be ensured, whereby damage to the needles and ribbon from jamming can be prevented. Moreover, since the solenoids are so designed that adjacent solenoids generate magnetic fluxes whose directions are opposite to each other, it is possible to reduce magnetic interference between adjacent solenoids. Thus, ordinary patterns, other than the upperline or underline, can be printed in an appropriate manner.

DETAILED DESCRIPTION

Prior to giving explanations of the present invention, the underline printing by a conventional printing head, which entails unsmoothed reciprocal movement of needles, will be explained.

Figure 4:
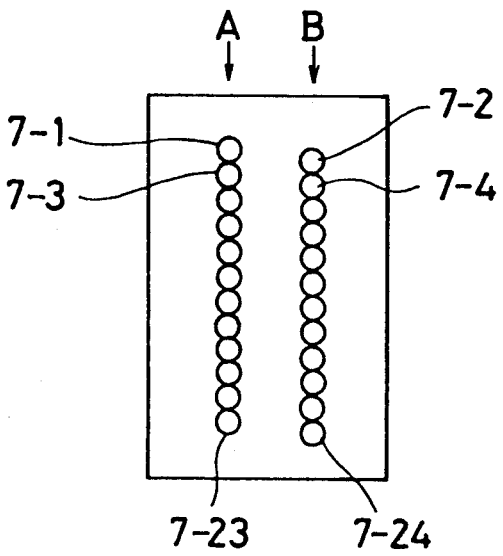
FIG. 4 is a schematic of an end view showing needles arranged in a zigzag array of two vertical columns.
Figure 5:
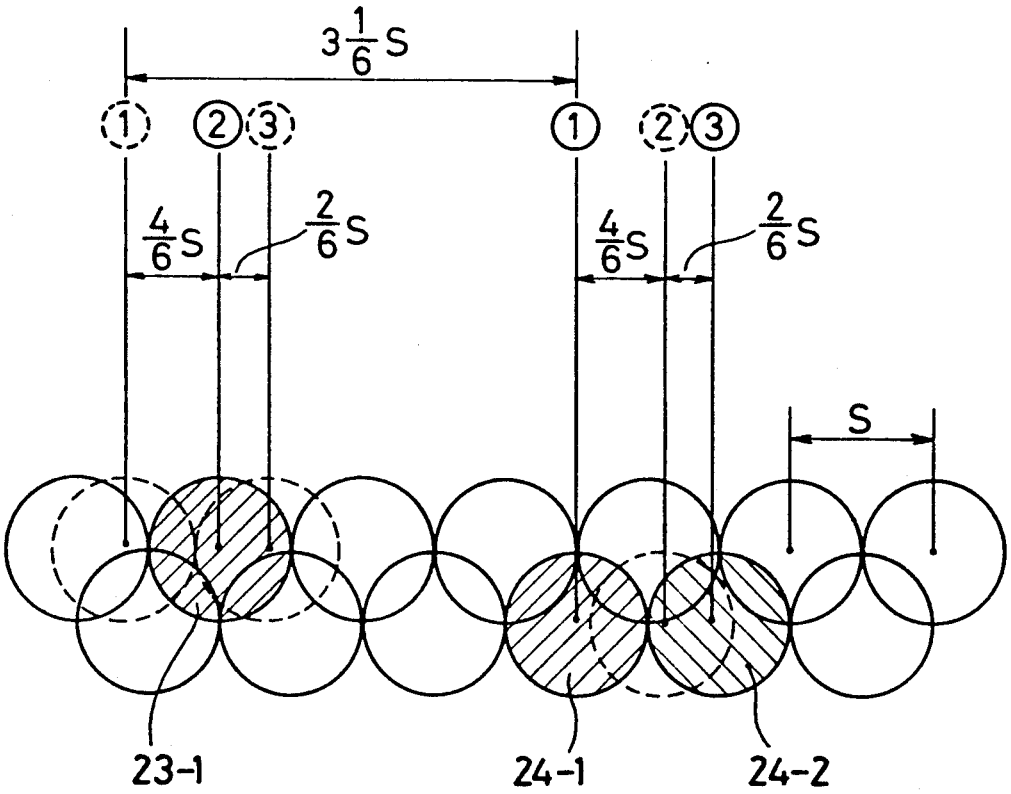
FIG. 5 is an enlarged diagram showing a dot formation state during underline printing by the needles shown in FIG. 4.

Referring to FIG. 4, the conventional printing head having needles whose tips are arranged in two vertical columns in zigzag fashion, comprises twelve needles 7*i* (i=1, 3, ---, 23) which cooperate to form a first needle column A, and twelve needles 7*j* (j=2, 4, ---, 24) forming a second needle column B. One of the needles 7*i* and a corresponding one of the needles 7*j* are vertically dislocated by the needle radius, and laterally separated by the needle distance of, e.g., (3+1/6)S, where symbol S represents the distance (positive dot distance) between the centers of those dots whose circumferences are in contact with each other, as shown in FIG. 5.

During underline printing in which needles 7-23 and 7-24 are alternately driven while the printing head runs at a speed of {(3+1/6)S}/t, the needle 7-24 is first operated to print a dot 24-1 (①). After the elapse of a time period (4/6)t from the instant at which the dot 24-1 is printed, the needle 7-23 is driven to print a dot 23-1 (②). After the elapse of a further time period (2/6)t, the needle 7-24 is driven to print a dot 24-2 (③). Whereupon, the two needles are alternately driven, so as to obtain the underline having a width of (3/2)S.

Figure 6:
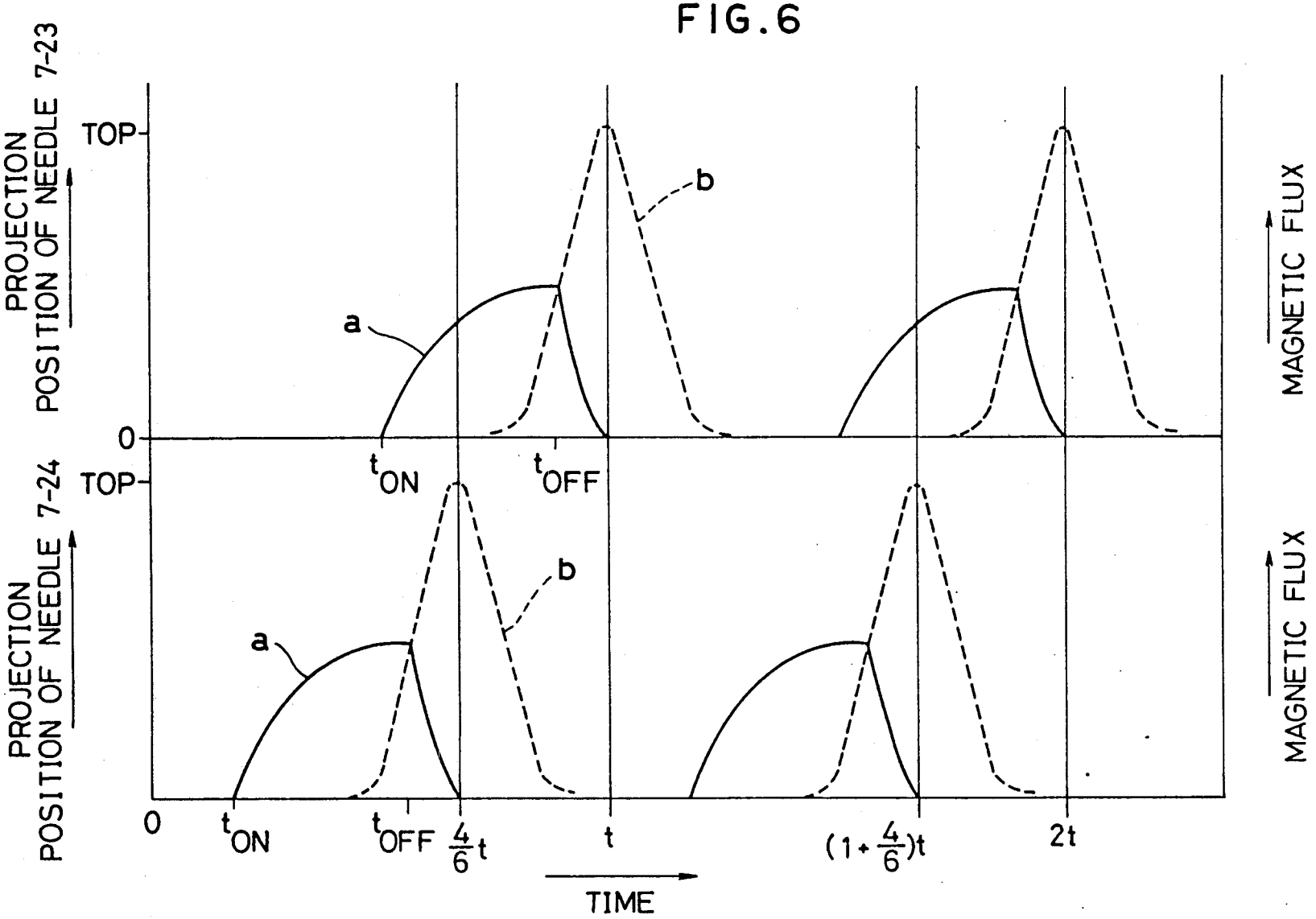
FIG. 6 is a graph, similar to FIG. 3, showing changes of magnetic fluxes and needle projection positions under an ideal state wherein no magnetic interference occurs between two solenoids associated with underline printing.

During the underline printing under ideal conditions, in which no magnetic interference occurs between two solenoids 3-23 and 3-24, as shown in FIG. 6, the generation of a magnetic flux, associated with each solenoid, starts at $t_{ON}$ at which each solenoid is energized. Thereafter, the magnetic flux appropriately rises, as shown by the curve a. The magnetic flux is extinguished when a corresponding needle, which is projected as shown by the curve b, reaches its forwardmost position TOP after the elapse of a predetermined time period from $t_{OFF}$ at which the solenoid is deenergized. As a result, the needle is rapidly restored immediately after the same needle reaches the forwardmost position TOP to form a dot. Thus, the needle is never caught by the ink ribbon.

Figure 7:
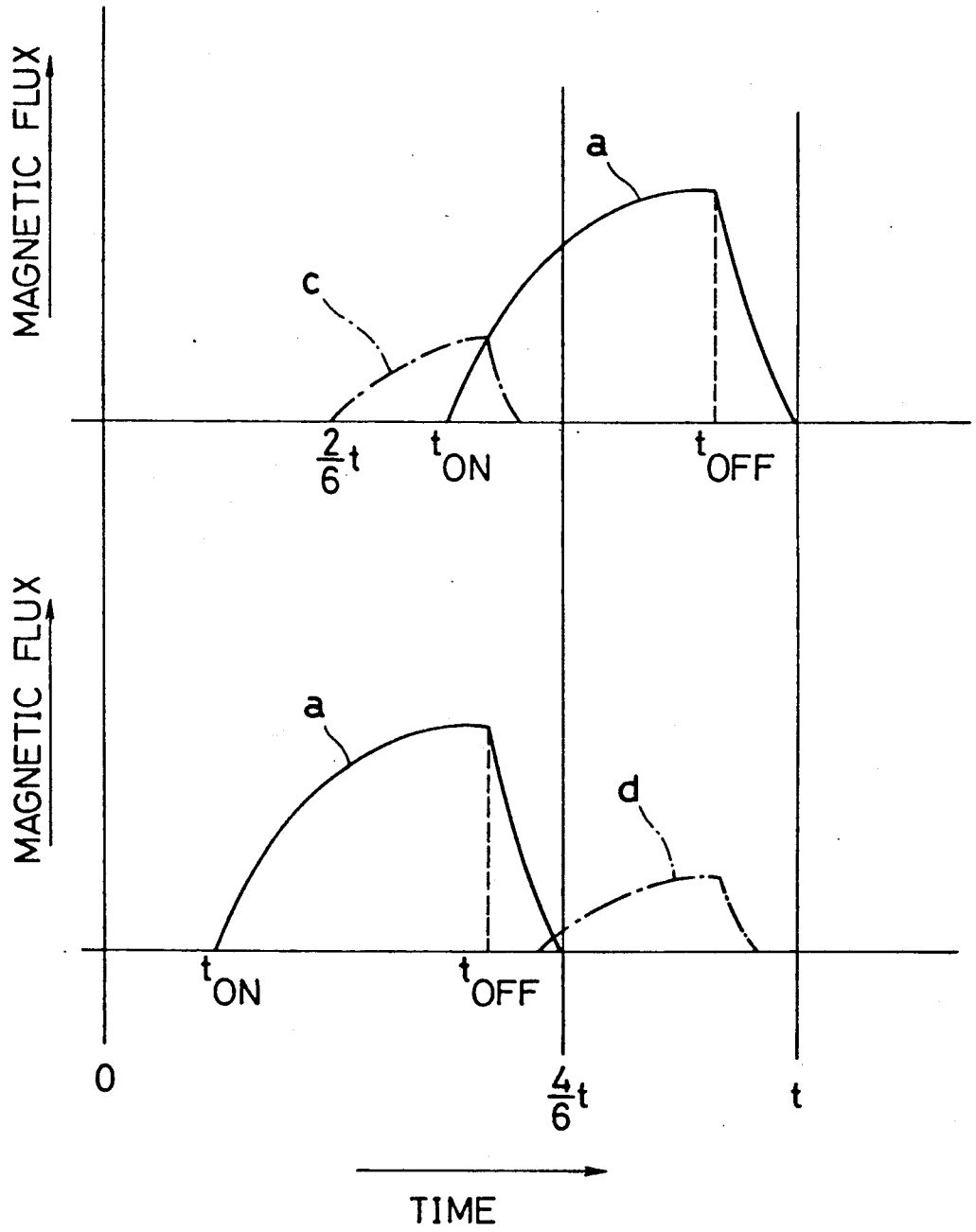
FIG. 7 is a graph showing changes of magnetic fluxes generated by two solenoids and changes of magnetic fluxes which contribute magnetic interference between these solenoids.

On the other hand, if magnetic interference occurs between the solenoids 3-23 and 3-24, and if these solenoids generate magnetic fluxes whose directions are opposite to each other, part c of the magnetic flux a, generated by the solenoid 3-24 energized before the excitation starting time $t_{ON}$ of the solenoid 3-23, acts upon the solenoid 3-23 at the time $t_{ON}$, as shown in FIG. 7. Moreover, at the excitation ending time $t_{OFF}$, part d of the magnetic flux a generated by the solenoid 3-23 acts upon the solenoid 3-24.

Figure 8:
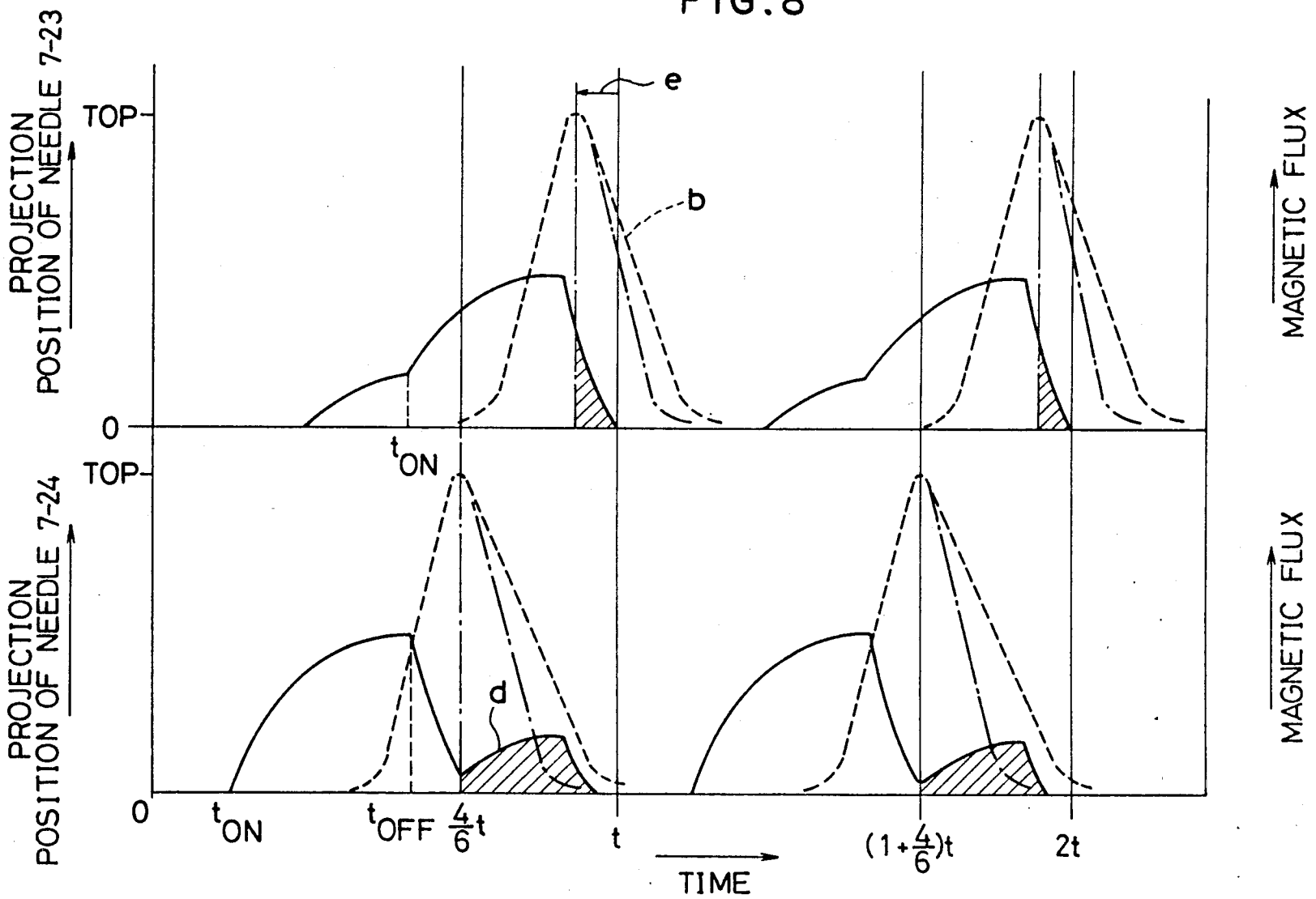
FIG. 8 is a graph showing changes of magnetic fluxes generated by two solenoids, which are associated with underline printing in a conventional printing head and between which magnetic interference occurs, and changes of projection positions of two needles associated with these solenoids.

In this case, excessive magnetic flux contributes to the projecting action of the needle 7-23, so that the needle 7-23 reaches the forwardmost position TOP at a time which is earlier than a predetermined time t by a time period e. Further, even after arrival to the forwardmost position TOP, there still remains residual magnetic flux, as shown by hatching in FIG. 8, so that the needle 7-23 becomes slow in its restoring action. As a consequence, a time period for which the needle is in contact with the ink ribbon is prolonged, so that the tip of the needle can be entrapped by the ink ribbon, and normal printing action can be prevented. With regard to the needle 7-24, there occurs no change of the time at which the forwardmost position TOP is to be reached. However, the restoring action of the needle 7-24 becomes slow because part d of the magnetic flux generated by the solenoid 3-23 acts upon the needle 3-24, as shown by hatching in FIG. 8, after the elapse of the excitation ending time point $t_{OFF}$. This causes the aforesaid drawback.

Figure 1:
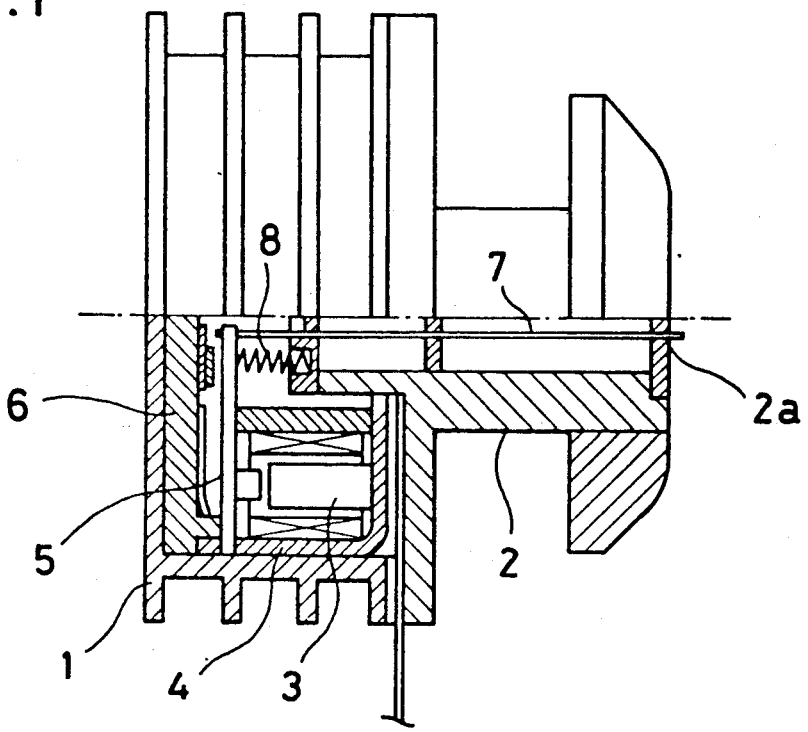
FIG. 1 is a diagram of a side view of a printing head according to an embodiment of the present invention, with the lower half of the printing head shown in longitudinal cross section.
Figure 2:
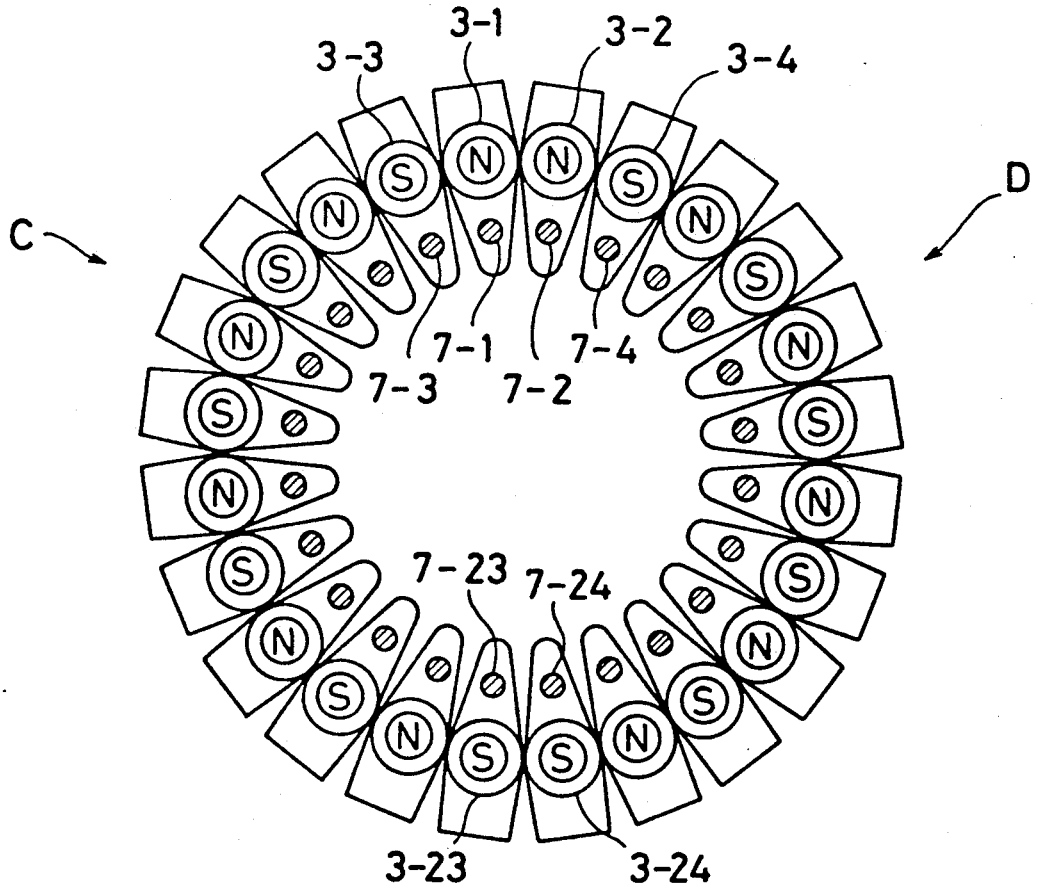
FIG. 2 is enlarged schematic of the printing head of FIG. 1 together with peripheral elements showing solenoids, arranged in an annular array.

With reference to FIGS. 1 and 2, a printing head according to an embodiment of the present invention, which is mounted on an impact dot printer of a type having 24 pins or needles, is explained.

The printing head comprises a cylindrical housing 1, and a cylindrical needle holder 2 fixed to the front end face of the housing. Within the interior of the housing 1, twenty-four solenoids 3 are, as a whole, arranged in an annular array (hereinafter, each of the solenoids is specified by affixing a corresponding one of suffixes 1 to 24, where required). These solenoids are supported by solenoid bases 4 fixed to the housing 1. Armatures 5 disposed in facing relation to the solenoids 3 are supported by armature bases 6 comprised of synthetic resin and fixed to the housing 1.

Figure 3:
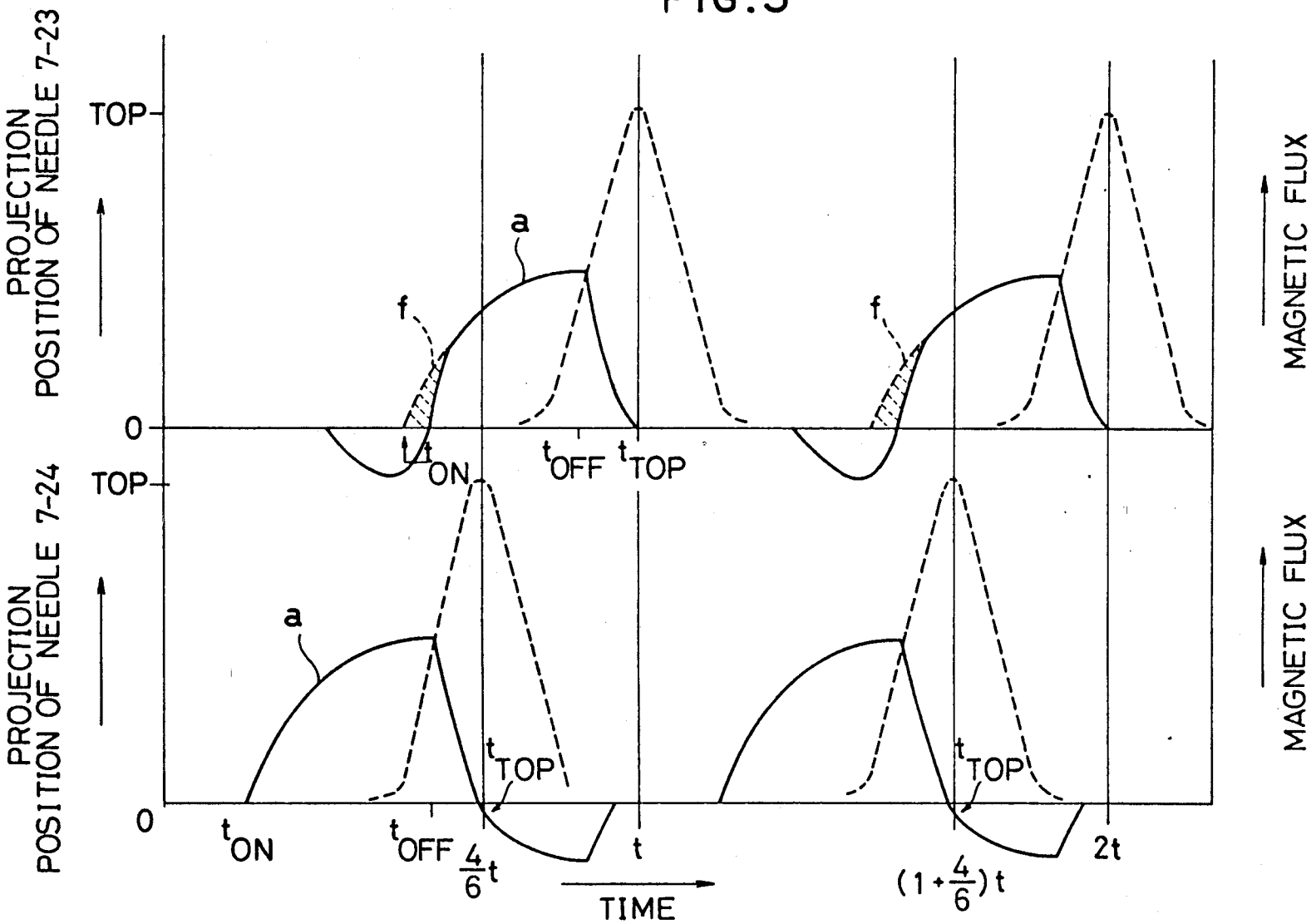
FIG. 3 is a graph showing changes of magnetic fluxes and needle projection positions with the elapse of time, which are associated with two needles whose tip ends are disposed laterally adjacent to each other at the side close to the lower end of the printing head of FIGS. 1 and 2.

The printing head further comprises twenty-four needles 7 which respectively correspond to the twenty-four solenoids 3 and whose tip ends are arranged in a zigzag array of two vertical columns, as shown in FIG. 3. Each needle 7 has its proximal end fixed to the inner free of the armature 5, and a tip end portion thereof extending through a distal opening 2*a* of the needle holder 2. The needles 7 consist of a first needle group, i.e., twelve needles 7*i* (i=1, 3, ---, 23) which cooperate to form a first needle column A, and a second needle group, i.e., twelve needle 7*j* (j=2, 4, ---, 24) forming a second needle column B. In FIG. 1, reference numeral 8 denotes one of springs which urges a corresponding needle 7 in the restoring direction.

The solenoids 3 consist of twelve solenoids 3*i* corresponding to the needles 7*i* and forming a first solenoid group, and twelve solenoids 3*j* corresponding to the needles 7*j* and forming a second solenoid group. As shown in FIG. 2, the solenoids 3*i* are arranged on a first semicircle C of the annular array in the same order as that of the needles 7*i* on the first needle column A. Similarly, the solenoids 3*j* are arranged on a second semicircle D of the annular array in the same order as that of the needles 7*j* on the second needle column B.

Adjacent ones of the solenoids 3*i* on the first semicircle C are designed to generate, when energized, magnetic fluxes whose directions are opposite to each other. Namely, the respective coils of the solenoids 3*i* are wound in those winding directions which satisfy the aforementioned requirement regarding the directions of the resultant magnetic flux. In other words, the energized solenoids have their polarities as shown in FIG. 2. Similarly, adjacent ones of the solenoids 3*j* on the second semicircle D are designed to generate magnetic fluxes whose directions are opposite to each other when they are energized.

Moreover, the solenoid 3-23, corresponding to the needle 7-23 disposed at the lower end of the first needle column A, is disposed at the lower end of the first semicircle C, and the solenoid 3-24, corresponding to the needles 7-24 laterally adjoined to the needle 7-23 on the zigzag array of two vertical columns and disposed at the lower end of the second needle column B, is disposed at the lower end of the second semicircle D. Both solenoids are designed so that magnetic fluxes whose directions are the same with each other are generated when they are energized (FIG. 2). Preferably, the solenoid 3-1 at the upper end of the first semicircle C and the solenoid 3-2 at the upper end of the second semicircle D are designed to generate magnetic fluxes acting in the same direction.

In the following, the operation of the printing head constructed as mentioned above is explained.

Basically, the printing head operates in a conventional manner. That is, when a certain solenoid 3 is energized, a corresponding one armature 5 is magnetically attracted toward the solenoid 3 to pivot around the outer end of the armature, serving as a fulcrum, against the spring force of the spring 8, so that the needle 7 concerned is moved forward through the distal opening 2*a* of the needle holder 2, thereby printing one dot. When the solenoid 3 is deenergized, the armature 5 is urged by the spring 8 to be moved back to its retreat position which is restricted by the armature base 6, to thereby move the needle 7 backward.

During underline printing, timing pulses which are generated in dependence on the travel position of the printing head are alternately applied to the solenoids 3-23 and 3-24. More specifically, as in the case of the conventional arrangement which has been explained with reference to FIG. 5, after the elapse of a time period (4/6) t from the excitation starting time $t_{ON}$ of the solenoid 3-24, the solenoid 3-23 is energized. After the elapse of a further time period (2/6)t, the solenoid 3-24 is energized. Thereafter, a similar excitation control is performed. During the underline printing, magnetic interference occurs between these solenoids 3-23 and 3-24. However, as distinct from the conventional arrangement, the generated magnetic fluxes are in the same in direction with each other. As a result, each of magnetic fluxes c and d shown by one-dotted chain line in FIG. 7 acts in that direction which is opposite to that in the conventional arrangement of FIG. 8. Accordingly, a combined magnetic flux of the magnetic flux generated by each solenoid 3-23, 3-24 and a corresponding one of the magnetic fluxes c and d changes as shown by the solid line a in FIG. 3 with the elapse of time.

As a result, the magnetic flux which contributes the forward movement of the needle 7-23 slightly decreases, as shown by the hatching f in FIG. 3, due to the effect of part c of the magnetic flux generated by the solenoid 3-24 at the instant just after the excitation starting time $t_{ON}$ of the solenoid 3-23. Therefore, the projecting action of the needle 7-23 becomes slightly slow at an early stage of the same action. However, the needle 7-23 reaches the forwardmost position TOP at each of the predetermined times t, 2t, ---. Namely, the time $t_{TOP}$ at which the forwardmost position is to be reached never occurs be too soon, as contrasted from the case shown in FIG. 8 subject to an excessive magnetic flux. Moreover, the restoring action of the needle 7-23 is never prevented by a residual magnetic flux, so that the needle is rapidly withdrawn into the needle holder 2, because the magnetic flux generated by the solenoid 3-23 has been fully extinguished at the time $t_{TOP}$. Accordingly, the prevention of the tip of the needle from being caught by the ink ribbon is ensured, whereby damage to the needle and ribbon from jamming can be eliminated.

After the start of excitation of the solenoid 3-24, the magnetic flux generated by the same solenoid normally rises, and accordingly, the needle 7-24 reaches its forwardmost position TOP at each predetermined time point (4/6)t, {1+(4/6)}t, ---. During the restoring action of the needle 7-24, on one hand, the magnetic flux generated by the solenoid 3-24 is fully extinguished, and on the other hand, part d of the magnetic flux generated by the solenoid 3-23 acts upon the solenoid 3-24. However, the restoring action of the needle 7-24 never be adversely affected, because, in the printing head of the present embodiment, the magnetic flux d acts in that direction which is opposite to that in the conventional arrangement of FIG. 8. Thus, the needle is rapidly restored, and hence the tip end thereof never be caught by the ink ribbon.

The present invention is not limited to the foregoing embodiment which relates to a printing head of 24 pin type, and may be applied to printing heads of various types having needles whose tips are arranged in two vertical columns.

What is claimed is:

1. A printing head consisting of first and second needle groups, each group consisting of a plurality of needles having tips arranged in a vertical column;

solenoids arranged in an annular array for driving the needles, the annular array comprising first and second semicircular groups of solenoids;

said solenoids forming each semicircular group being arranged in the same order as the group of needles forming the corresponding needle column;

adjacent solenoids in each semicircular group being designed to generate, when energized, magnetic fluxes whose directions are opposite to each other; and one of two end solenoids of said first semicircular group and at least one end solenoid of said second semicircular group, which is adjacent to said one of the two end solenoids of said first semicircular group, being designed to generate, when energized, a magnetic flux whose direction is the same as that generated by the adjacent end solenoid of said first semicircular group.

* * * * *